US009382793B2

(12) United States Patent
Brennan, III

(10) Patent No.: US 9,382,793 B2
(45) Date of Patent: Jul. 5, 2016

(54) PROBE PACKER INCLUDING RIGID INTERMEDIATE CONTAINMENT RING

(71) Applicant: Schlumberger Technology Corporation, Sugar Land, TX (US)

(72) Inventor: William E. Brennan, III, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 629 days.

(21) Appl. No.: 13/721,405

(22) Filed: Dec. 20, 2012

(65) Prior Publication Data

US 2014/0174721 A1 Jun. 26, 2014

(51) Int. Cl.
*E21B 49/10* (2006.01)

(52) U.S. Cl.
CPC . *E21B 49/10* (2013.01); *Y10T 29/49* (2015.01)

(58) Field of Classification Search
CPC ..... E21B 49/10
See application file for complete search history.

(56) References Cited

U.S. PATENT DOCUMENTS

| | | | | |
|---|---|---|---|---|
| 6,301,959 | B1 | 10/2001 | Hrametz et al. | |
| 6,658,930 | B2 | 12/2003 | Abbas | |
| 6,729,399 | B2 | 5/2004 | Follini et al. | |
| 7,114,385 | B2 | 10/2006 | Fisseler et al. | |
| 7,114,562 | B2 | 10/2006 | Fisseler et al. | |
| 7,121,338 | B2 | 10/2006 | van Zuilekom et al. | |
| 7,128,144 | B2 | 10/2006 | Fox et al. | |
| 7,395,879 | B2 | 7/2008 | Segura et al. | |
| 7,584,655 | B2 | 9/2009 | van Zuilekom et al. | |
| 7,584,786 | B2 | 9/2009 | Nold, III et al. | |
| 7,603,897 | B2 | 10/2009 | Gilbert et al. | |
| 7,650,937 | B2 | 1/2010 | Fox et al. | |
| 7,654,321 | B2 | 2/2010 | Zazovsky et al. | |
| 7,841,406 | B2 | 11/2010 | Zazovsky et al. | |
| 8,015,867 | B2 | 9/2011 | Kerr et al. | |
| 8,210,260 | B2 | 7/2012 | Milkovisch et al. | |
| 8,235,106 | B2 | 8/2012 | Fox et al. | |
| 2006/0075813 | A1* | 4/2006 | Fisseler et al. | 73/152.26 |
| 2007/0151727 | A1 | 7/2007 | Tao et al. | |
| 2010/0132970 | A1 | 6/2010 | Axland et al. | |
| 2011/0107830 | A1 | 5/2011 | Fields et al. | |
| 2011/0284227 | A1* | 11/2011 | Ayan | E21B 43/16 166/307 |

* cited by examiner

*Primary Examiner* — David Andrews
(74) *Attorney, Agent, or Firm* — Kenneth L. Kincaid

(57) ABSTRACT

A downhole tool for a wellbore within a geological formation may include a housing to be lowered into the wellbore, a probe carried by the housing having a first opening therein, and a packer carried by the probe. The packer may include a rigid base having a second opening therein aligned with the first opening, an inner elastomeric ring carried by the rigid base and having a third opening aligned with the second opening, a rigid intermediate containment ring carried by the rigid base and surrounding the inner elastomeric ring, and an outer elastomeric ring carried by the rigid base and surrounding the rigid intermediate containment ring.

17 Claims, 4 Drawing Sheets

PROBE PACKER INCLUDING RIGID INTERMEDIATE CONTAINMENT RING

BACKGROUND

Wellbores are drilled in geological formations (on land or offshore) to locate and recover hydrocarbons. A downhole drilling tool with a bit at an end thereof is advanced into the ground to form the wellbore. As the drilling tool is advanced, a drilling mud is pumped through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. These samples or tests may be used, for example, to locate and evaluate valuable hydrocarbons.

Formation evaluation often involves drawing fluid from the formation into the downhole tool for testing and/or sampling. Various devices, such as probes, are extended from the downhole tool to establish fluid communication with the formation surrounding the wellbore and draw fluid into the downhole tool. A probe is an element that may be extended from the downhole tool and positioned against the sidewall of the wellbore. A packer at the end of the probe is used to create a seal with the wall of the formation. The mudcake lining the wellbore is often useful in assisting the packer in making the seal. Once the seal is made, fluid from the formation is drawn into the downhole tool through an inlet in the probe by lowering the pressure in the downhole tool.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool for a wellbore within a geological formation may include a housing to be lowered into the wellbore, a probe carried by the housing having a first opening therein, and a packer carried by the probe. The packer may include a rigid base having a second opening therein aligned with the first opening, an inner elastomeric ring carried by the rigid base and having a third opening aligned with the second opening, a rigid intermediate containment ring carried by the rigid base and surrounding the inner elastomeric ring, and an outer elastomeric ring carried by the rigid base and surrounding the rigid intermediate containment ring.

A packer is also provided to be carried by a probe on a downhole tool for use within a wellbore in a geological formation, where the probe has a first opening therein. The packer may include a rigid base having a second opening therein aligned with the first opening, an inner elastomeric ring carried by the rigid base and having a third opening therein aligned with the second opening, a rigid intermediate containment ring carried by the rigid base and surrounding the inner elastomeric ring, and an outer elastomeric ring carried by the rigid base and surrounding the rigid intermediate containment ring.

A related method is for making a packer to be carried by a probe on a downhole tool for use within a wellbore in a geological formation, where the probe has a first opening therein. The method may include forming a rigid base having a second opening therein with a rigid intermediate containment ring carried by the rigid base surrounding the opening, with the second opening to be aligned with the first opening. The method may also include forming an inner elastomeric ring having a third opening therein to be aligned with the second opening when the inner elastomeric ring is within the rigid intermediate containment ring, and forming an outer elastomeric ring on the rigid base and surrounding the rigid intermediate containment ring.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete Like numbers refer to like elements throughout.

Figure 1:
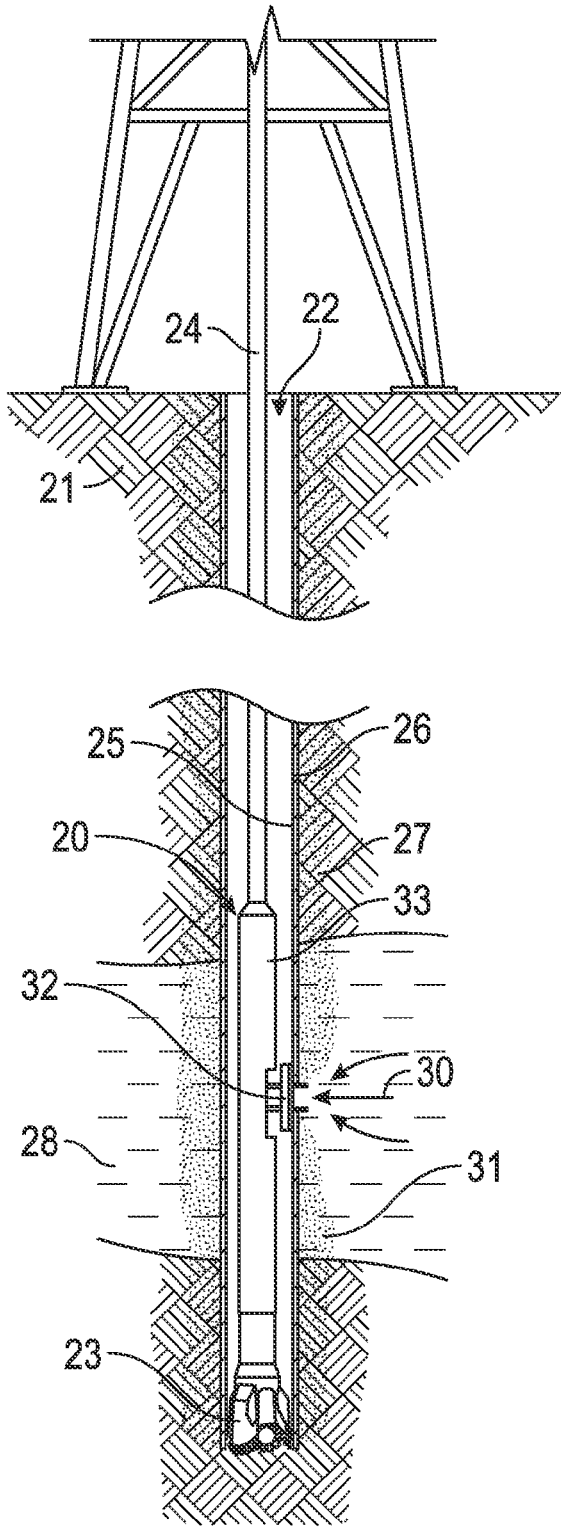
FIG. 1 is a front view, partially in cross-section, of a downhole tool deployed from a rig into a wellbore in accordance with an example embodiment.
Figure 2:
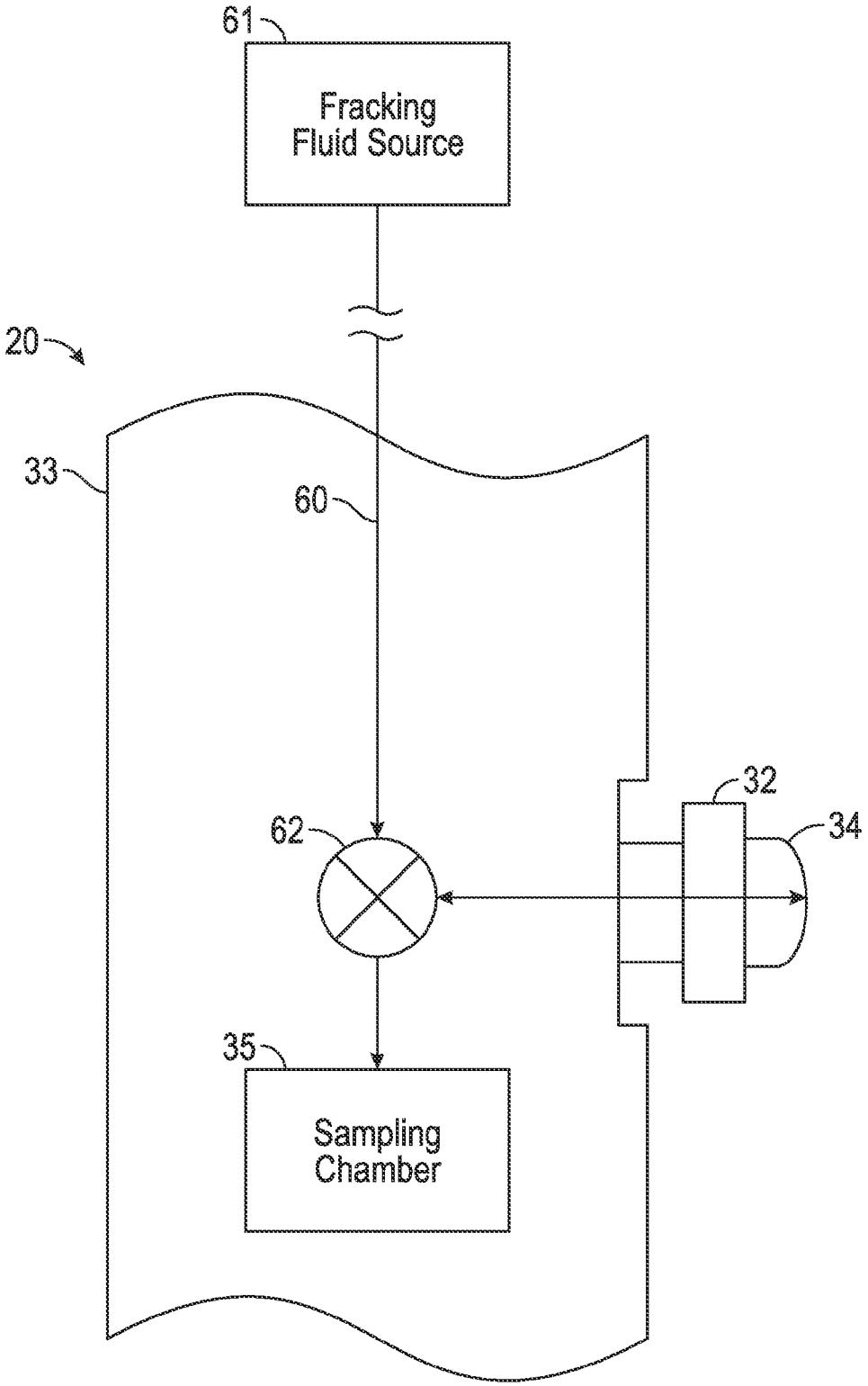
FIG. 2 is a schematic diagram of the downhole tool of FIG. 1 in accordance with an example embodiment.

Referring initially to FIGS. 1 and 2, a downhole tool 20 may be advanced into a geological formation 21 (either onshore or offshore) to form a wellbore or borehole 22, which may be used to collect samples from within the borehole. In the illustrated example, the drilling tool 20 has a bit 23 at an end thereof adapted to cut into the formation 21 to form the wellbore 22. That is, in the illustrated example the downhole tool 20 is part of a logging-while-drilling (LWD) or measurement-while-drilling (MWD) implementation, but in other embodiments the downhole tool may be implemented as a wireline device without the drill bit 23, which is lowered into a previously drilled borehole, as will be appreciated by those skilled in the art. However, it will also be appreciated that the probe/packer configurations described herein may also be used in other downhole tools adapted to draw fluid therein, such as coiled tubing, casing drilling and other variations of downhole tools, for example.

The downhole tool 20 is deployed into the wellbore 22 via a drill string 24 in the illustrated example. As the downhole tool 20 is advanced, a drilling mud (not shown) is pumped into the wellbore 22 through the drilling string 24 and out of the bit 23. The mud is circulated up the wellbore 22 and back to the surface for recycling. As the downhole tool 20 advances and mud is pumped into the wellbore 22, the mud may seep into sidewalls 25 of the wellbore 22 and penetrate the surrounding formation. As indicated by reference number 26, the mud lines the wellbore wall 25 and forms a mudcake along the wellbore wall. Mud which penetrates the wall 25 of the wellbore 22 forms an invaded zone 27 along the wellbore wall 25. As shown, the borehole 22 penetrates a formation 28 including a hydrocarbon fluid 30 therein. In the present example, a portion of the drilling mud 26 seeps into the formation 28 along the invaded zone 27 and contaminates the hydrocarbon fluid 30. The contaminated hydrocarbon fluid is indicated by reference number 31.

The downhole tool 20 is provided with a fluid communication device, such as a probe 32. The probe 32 extends from a housing 33 of the downhole tool 20 and carries a packer 34 thereon which forms a seal with the mudcake 26 lining the sidewall 25. The packer 34 may be secured to the probe 32 by bonding, mechanical coupling or other techniques, for example. When samples are to be collected, the probe 32 may be extendable and retractable from the downhole tool 20 by selective activation of one or more pistons, for example (not shown). In other configurations, the probe 32 may remain fixed, and one or more retractable feet (not shown) on an opposite side of the housing 33 from the probe 32 may be used to press the packer 34 into the wall of the 25 of the borehole 22, for example, as will be appreciated by those skilled in the art.

A fluid then flows into the downhole tool 20 via the probe 32 and packer 34, and may be collected in a sampling chamber 35 carried within the housing 33 (although in some embodiments the collected sample material may be transported to the surface via a tube or pipe, for example). A vacuum pump (not shown) may optionally be used to create vacuum pressure to draw the sample material into the sampling chamber 35 through the probe 32 and packer 34. Control of the above-described operations (e.g., probe/vacuum pump actuation, etc.) may be performed remotely from the surface via telemetry or other borehole communication techniques, as will be appreciated by those skilled in the art.

Figure 3:
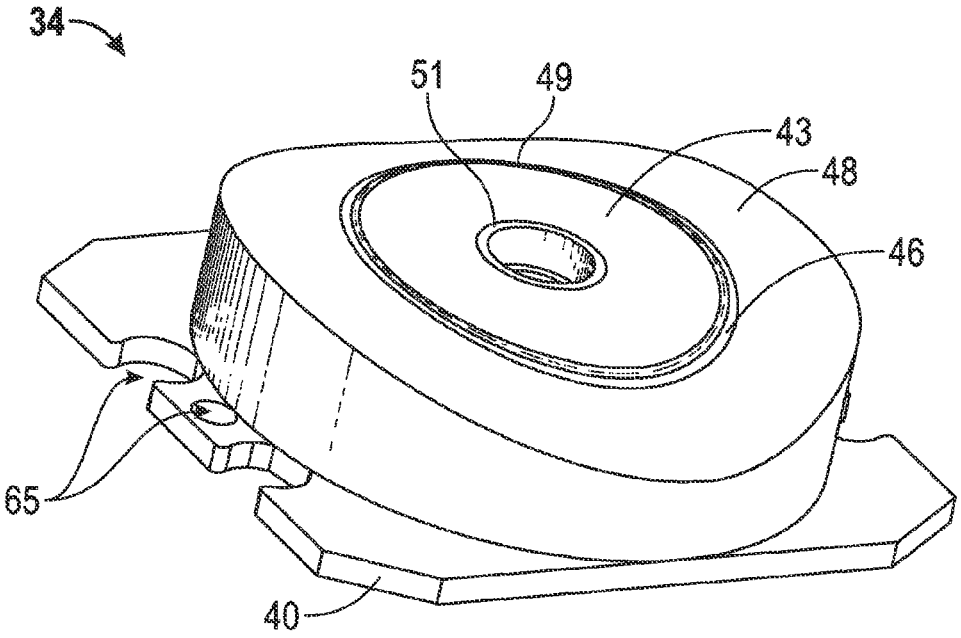
FIG. 3 is a perspective view of a probe packer for use with the downhole tool of FIG. 1.

An example configuration of the packer 34 will now be described with reference to FIGS. 3-5. As will be discussed further below, in addition to receiving samples from the geological formation, the packer 34 may also be used for injecting fracking fluid into the geological formation 21, which may help with the sampling process. The packer 34 illustratively includes a rigid base 40 having an opening 41 therein (see FIG. 5). In the illustrated example, the probe 32 includes a rigid fluid tube 50, which may also be referred to as a probe barrel, which defines a fluid inlet and/or outlet to the probe and is in fluid communication with the opening 41. The packer 34 further illustratively includes an inner elastomeric ring 43 carried by the base 40 and having a central opening or passageway which surrounds the rigid fluid tube 50. The rigid fluid tube 50 may extend through the inner elastomeric ring 43 during the setting process, as will be described further below, and may extend to the sidewall 25 of the geological formation 21 during operation. However, it should be noted that in some embodiments a probe assembly may be used which does not have an extending rigid fluid tube 50, and the packer 34 may include a rigid fluid tube carried within the opening 41 of the rigid base 40 and the inner elastomeric ring 43.

A rigid intermediate containment ring 44 is carried by the base 40 and surrounds the inner elastomeric ring 43. More particularly, the rigid intermediate containment ring 44 illustratively includes an outer ring member 45 coupled to the base 40, and an inner ring member 46 spaced from the base and slidably received within the outer ring member. The outer ring member 45 further illustratively includes an enlarged thickness proximal portion coupled to the base 40, and a reduced thickness distal portion as seen in FIG. 5. The enlarged thickness proximal portion may help provide a greater area of contact with the base 40, to thereby provide increased strength against outward pressure resulting from compression of the inner elastomeric ring 43, as will be discussed further below. An outer elastomeric ring 48 is carried by the base and surrounds the rigid intermediate containment ring 44.

Figure 4:
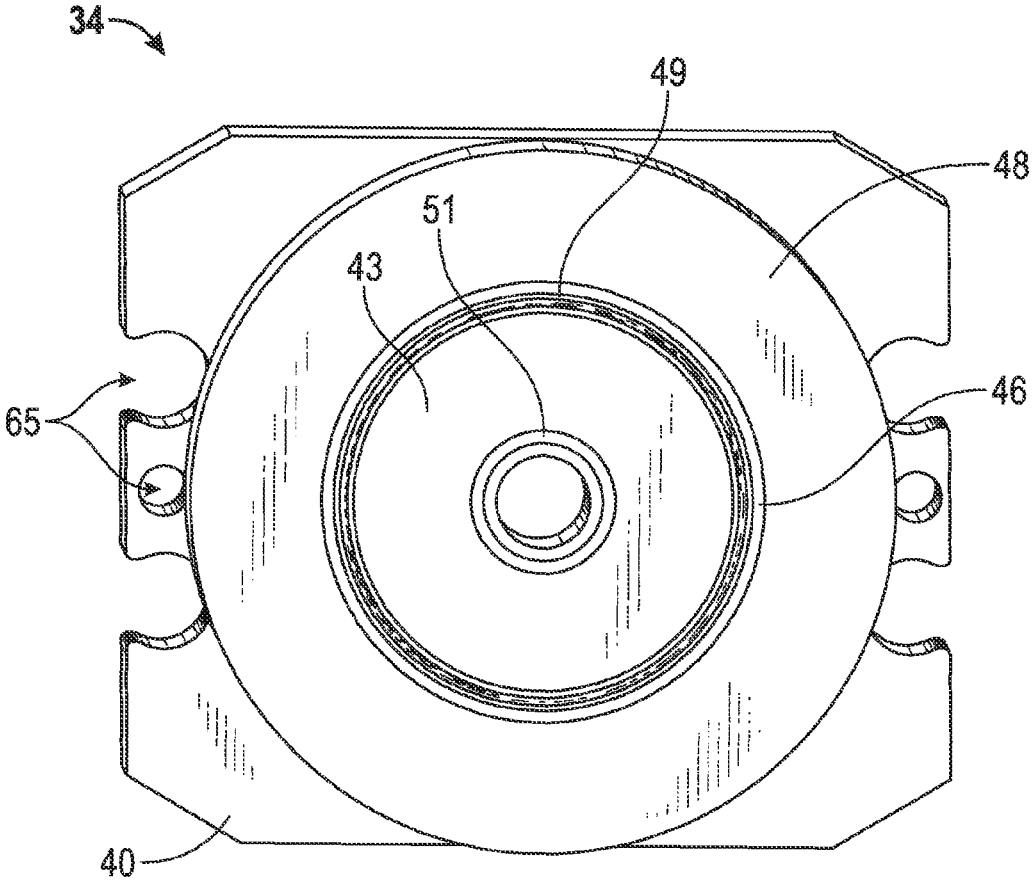
FIG. 4 is a top view of the probe packer of FIG. 3.

As may perhaps best be seen in FIG. 4, the rigid fluid tube 50, inner elastomeric ring 43, rigid intermediate containment ring 44, and outer elastomeric ring 48 are concentrically arranged in the illustrated example. Additionally, in the present example, these components are circular (or cylindrical), although it will be appreciate that other shapes may be used in some embodiments, such as elliptical or oblong shapes, for example. Moreover, while a single rigid fluid tube 50 is shown in the present example, in some embodiments multiple fluid tubes may be used to provide multiple fluid inlets and/or outlets.

Figure 5:
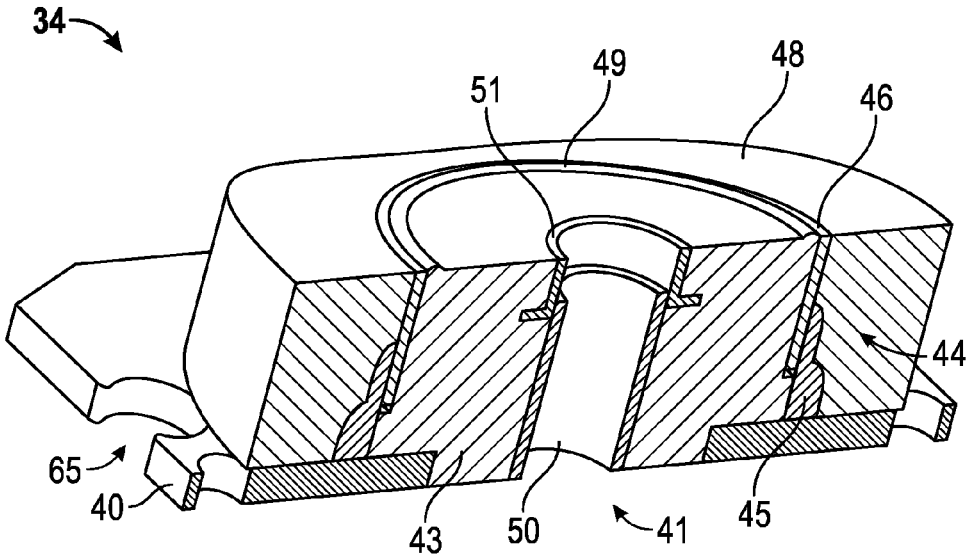
FIG. 5 is a cross-sectional view of the probe packer of FIG. 3 taken along 5-5.

An outer tube member 51 may optionally be spaced from the rigid base 40 and slidably received on the rigid fluid tube 50 (see FIG. 5). In some embodiments, the rigid fluid tube 50 may be provided with a filter therein (not shown) to screen contaminates as the fluid enters the downhole tool 20, if desired. The inner elastomeric body 43 also illustratively includes one or more optional annular ridges 49 adjacent the intermediate containment ring 44, which helps provide a seal with the sidewall 25 of the borehole 22. More particularly, annular ridge 49 is a small raised area on the surface of the inner elastomeric ring 43 just inside the inner ring member 46. This may accordingly help initialize and maintain a seal by increasing the force between the packer 34 and the borehole wall 25 adjacent the inner ring member 46. As the inlet pressure increases, the inner elastomeric ring 43 will be pressurized, which will push up against the intermediate containment ring 44, helping maintain the seal with the formation and containing the elastomeric material within the intermediate containment ring.

The packer 34 accordingly provides a seal with the formation 21. The seal may be used to prevent fluid from passing between the opening of the rigid fluid tube 50 and the wellbore wall 25. The seal is also used to establish fluid communication with the formation so that fluid may pass through the probe 32 without leakage. The packer 34 illustratively has a curved or arcuate outer surface (see FIG. 3) adapted to contact the cylindrical wall 25 of the wellbore 22. The packer 34 flattens and conforms to the wellbore wall 25 when the probe 32 is pressed against the wall, which causes the inner ring member 46 and outer ring member 45, as well as the rigid fluid tube 50 and outer tube member 51, to respectively slide against one another.

By way of comparison, a conventional probe packer may be designed to support a seal with the formation while a pressure drawdown or sample is taken. Both of these operations cause a lower pressure at the inlet of the probe, which is at the center of the packer. The differential pressure will allow fluid to flow from the formation into the probe assembly and then the tool. However, as noted above, the packer 34 may provide an additional capability to pressurize the inlet of the packer to force fluid into the formation, such as from a fracking fluid line 60 coupled to a fracking fluid source 61. This is done to fracture the formation 21, and then use the fracture(s) to more effectively pull the formation fluid 30 back into the tool 20 during the sampling operation. The downhole tool 62 illustratively includes a valve 62, which may be used to selectively switch between a fracking fluid flow being supplied to the packer 34, and a sample fluid flow being received from the packer.

More particularly, the packer 34 may help support or withstand the force radiating from the inlet toward the outer edge of the packer as a result of the relatively high pressure fracking fluid being forced out through the rigid fluid tube 50. This is achieved by the rigid intermediate containment ring 44, and more particularly the inner ring member 46, as well as the outer elastomeric ring 48. That is, the inner ring member 46 may help prevent the outward deformation of the inner elastomeric ring 43, as well as aid in maintaining the seal between the packer and the formation. In this respect the inner ring member 46 functions similar to a T-seal (such as those used in pistons that can move with pressure on either side of the seal), in that as a T-seal is pressurized, the elastic material will push up on the hard backup rings to make a seal. Without the inner ring member 46, the inner elastomeric ring 43 would be subject to gradual deformation and may be pushed away from the borehole wall, allowing less pressure to be built up for fracturing. The inner ring member 46 is acted on by the inner elastomeric ring 43, which pushes the inner ring member up against the borehole sidewall 25 to maintain a seal as the center inlet is pressurized.

In this way, the packer 34 may be considered as a "bi-directional" packer, which provides a seal that may increase the potential fracturing pressures compared to what would be possible with a conventional packer. The packer 34 may accordingly provide improved durability, sealing capability, adaptability to various wellbore conditions and sizes, and deformation resistance, for example.

Figure 6:
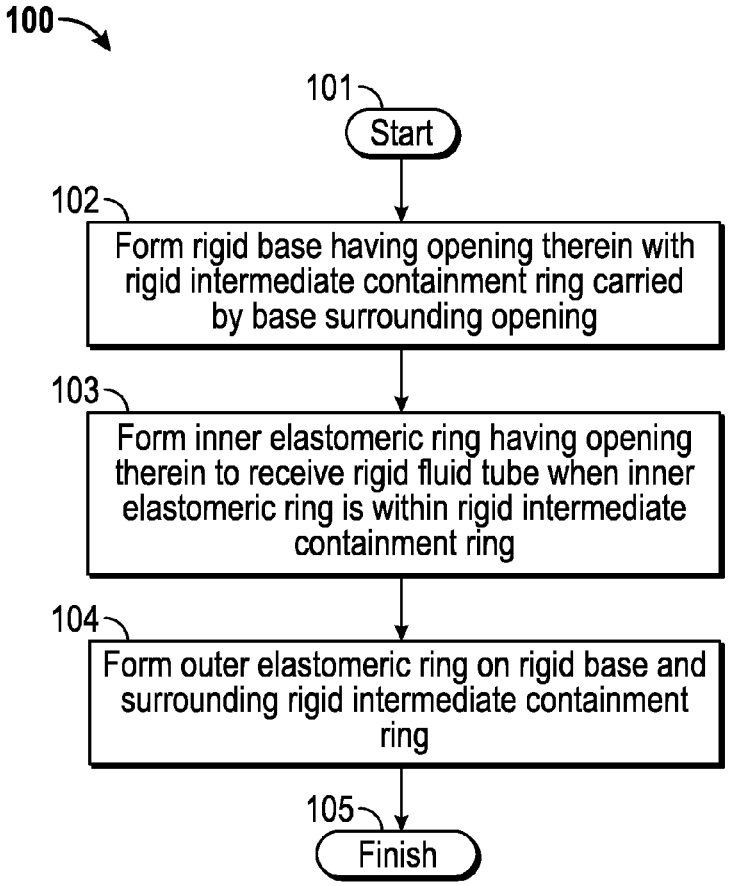
FIG. 6 is a flow diagram illustrating a method for making a probe packer in accordance with an example embodiment.

An example method for making the packer 34 will now be described with reference to the flow diagram 100 of FIG. 6. Beginning at Block 101, the rigid base 40, which makes the mechanical connection to the probe 32, may be formed from a rigid material such as metal or plastic with the central opening 41 and optional features 65 for receiving screws, bolts, etc., at Block 102. The outer ring member 45 may also be metal, plastic, etc., and may be integrally formed with the base 40 in some embodiments, or it may be separately formed and secured to the base by welding, brazing, an adhesive, etc.

The inner flexible elastomeric ring 43 may be formed in situ within the outer ring member 45 (e.g., the outer ring member may serve as a mold for the formation of the inner elastomeric ring), or the inner elastomeric ring may be formed separately and coupled to the base 40, at Block 103. In the latter case, the inner elastomeric ring 43 may be formed on a plate that may be connected to the base 40 via screws, etc., if desired. The outer elastomeric ring 48 may similarly be formed in situ, or formed separately and then coupled to the base 40 as with the inner elastomeric ring 43, at Block 104, which illustratively concludes the method shown in FIG. 6 (Block 105). By way of example, the flexible elastomeric rings 43, 48 may be made from natural rubber, as well as other flexible compounds that are suited to borehole conditions. One such compound is compound 8009 from Maloney Technical Products of Ft. Worth, Texas, although other suitable materials may also be used. The inner ring member 46, as well as the rigid fluid tube 50 and outer tube member 51, may also be made out of metal, plastic, etc., although other suitable rigid materials may also be used in some implementations. These components may be positioned in their respective locations at the appropriate point in the curing process of the inner elastomeric ring 43.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A downhole tool for a wellbore within a geological formation comprising:

a housing to be lowered into the wellbore;

a probe carried by said housing having a first opening therein; and a packer carried by said probe and comprising a rigid base having a second opening therein aligned with the first opening, an inner elastomeric ring carried by said rigid base and having a third opening aligned with the second opening, a rigid intermediate containment ring carried by said rigid base and surrounding said inner elastomeric ring, wherein said rigid intermediate containment ring comprises an outer ring member adjacent said rigid base, and an inner ring member spaced from said rigid base, and wherein the outer ring member and the inner ring member are configured to slide against one another when the packer is pressed against a wall of the wellbore, and an outer elastomeric ring carried by said rigid base, surrounding said rigid intermediate containment ring, and coupled to said rigid intermediate containment ring.

2. The downhole tool of claim 1 wherein said outer ring member comprises an enlarged thickness proximal portion adjacent said rigid base and a reduced thickness distal portion.

3. The downhole tool of claim 1 wherein said inner elastomeric ring, rigid intermediate containment ring, and outer elastomeric ring are concentrically arranged.

4. The downhole tool of claim 1 wherein said probe further comprises a rigid fluid tube extending through the second and third openings.

5. The downhole tool of claim 4 wherein said packer further comprises an outer tube member spaced from said rigid base and slidably received on said rigid fluid tube.

6. The downhole tool of claim 1 wherein said inner elastomeric ring comprises an annular ridge disposed on a surface of the inner elastomeric ring facing the wellbore and adjacent said intermediate containment ring.

7. The downhole tool of claim 1 further comprising a sampling chamber carried by said housing and coupled in fluid communication with the first opening.

8. The downhole tool of claim 1 further comprising:

a fracking fluid line coupled in fluid communication with the first opening; and a fracking fluid source coupled to the fracking fluid line.

9. A packer to be carried by a probe on a downhole tool for use within a wellbore in a geological formation, the probe having a first opening therein, and the packer comprising:

a rigid base having an second opening therein aligned with the first opening;

an inner elastomeric ring carried by said rigid base and having a third opening therein aligned with the second opening;

a rigid intermediate containment ring carried by said rigid base and surrounding said inner elastomeric ring, wherein said rigid intermediate containment ring comprises an outer ring member adjacent said rigid base, and an inner ring member spaced from said rigid base, and wherein the outer ring member and the inner ring member are configured to slide against one another when the packer is pressed against a wall of the wellbore; and an outer elastomeric ring carried by said rigid base, surrounding said rigid intermediate containment ring, and coupled to said rigid intermediate containment ring.

10. The packer of claim 9 wherein said outer ring member comprises an enlarged thickness proximal portion adjacent said rigid base and a reduced thickness distal portion.

11. The packer of claim 9 wherein said inner elastomeric ring, rigid intermediate containment ring, and outer elastomeric ring are concentrically arranged.

12. The packer of claim 9 wherein said inner elastomeric ring comprises an annular ridge disposed on a surface of the inner elastomeric ring facing the wellbore and adjacent said intermediate containment ring.

13. A method for making a packer to be carried by a probe on a downhole tool for use within a wellbore in a geological formation, the probe having a first opening therein, the method comprising:

forming a rigid base having a second opening therein with a rigid intermediate containment ring carried by the rigid base surrounding the opening, the second opening to be aligned with the first opening, and wherein the rigid intermediate containment ring comprises an outer ring member adjacent the rigid base, and an inner ring member spaced from the rigid base, and wherein the outer ring member and the inner ring member are configured to slide against one another when the packer is pressed against the wall of the wellbore;

forming an inner elastomeric ring having a third opening therein to be aligned with the second opening when the inner elastomeric ring is within the rigid intermediate containment ring; and forming an outer elastomeric ring on the rigid base, surrounding the rigid intermediate containment ring, and coupled to the rigid intermediate containment ring.

14. The method of claim 13 wherein the outer ring member comprises an enlarged thickness proximal portion adjacent the rigid base and a reduced thickness distal portion.

15. The method of claim 13 wherein the inner elastomeric ring, rigid intermediate containment ring, and outer elastomeric ring are concentrically arranged.

16. The method of claim 13 wherein the probe comprises a rigid fluid tube to extend through the second and third openings; and wherein forming the inner elastomeric ring further comprises positioning an outer tube member in the inner elastomeric ring to be spaced from the rigid base and slidably received on the rigid fluid tube when the inner elastomeric ring is within the rigid intermediate containment ring.

17. The method of claim 13 wherein the inner elastomeric ring comprises an annular ridge disposed on a surface of the inner elastomeric ring facing the wellbore and adjacent the intermediate containment ring.

* * * * *